United States Patent [19]

Martin et al.

[11] Patent Number: 4,930,281

[45] Date of Patent: Jun. 5, 1990

[54] WALL REPAIR DEVICE AND METHOD OF USE

[75] Inventors: Danny T. Martin; Jim G. Schreiner, both of Sacramento, Calif.

[73] Assignee: J & M Home Products, Inc., Sacramento, Calif.

[21] Appl. No.: 350,515

[22] Filed: May 11, 1989

[51] Int. Cl.[5] ..... E02D 37/00; E04G 23/00

[52] U.S. Cl. ..... 52/514; 264/36; 264/321

[58] Field of Search ..... 124/65, 79; 52/514; 264/321, 36; 428/16

[56] References Cited

U.S. PATENT DOCUMENTS

| | | | |
|---|---|---|---|
| 2,149,749 | 3/1936 | Savage | 124/65 |
| 2,449,187 | 9/1948 | Walters | 124/65 |
| 2,760,302 | 8/1956 | Cheskin | 264/321 |
| 3,583,122 | 6/1971 | Biegajski | 52/514 |
| 3,766,902 | 10/1973 | Repinski | 124/65 |
| 3,936,988 | 2/1976 | Miceli | 52/514 |
| 4,062,165 | 12/1977 | Marks et al. | 52/514 |
| 4,075,809 | 2/1978 | Sirkin | 52/514 |
| 4,100,712 | 7/1978 | Hyman | 52/514 |
| 4,285,183 | 8/1981 | Condit | 52/514 |
| 4,297,823 | 11/1981 | Keisler . | |
| 4,335,554 | 6/1982 | Nicholson | 52/514 |
| 4,408,429 | 10/1983 | Neal . | |
| 4,715,151 | 12/1987 | Garblik | 52/514 |

*Primary Examiner*—James L. Ridgill, Jr.
*Attorney, Agent, or Firm*—James M. Ritchey

[57] ABSTRACT

A wall repair device and method of use are disclosed. The device comprises a plunger shaped to fit within a barrel containing a compressed support member. The barrel is fitted into a hole in a wall surface and the plunger inserted within the barrel to deliver the support member which expands within a wall space behind the wall surface. The expanded support member functions as a support for applying a filler compound to mend the hole.

13 Claims, 1 Drawing Sheet

WALL REPAIR DEVICE AND METHOD OF USE

BACKGROUND OF THE INVENTION

1. Field of the Invention

A device is disclosed for quickly repairing a hole in a wall surface, wherein the wall surface is generally made of wallboard, dry wall, plasterboard, or plaster type materials. The device allows the user to apply a minimum amount of sealing or filler compound directly to a support inserted within a wall space or cavity behind the hole. More particularly, the present invention relates to a wall repair device and method of use wherein the device comprises a plunger shaped to fit within a barrel containing a compressed support member. After the barrel is fitted into a hole in a wall surface, the plunger is inserted within the barrel to deliver the support member, which expands within a wall space behind the wall surface. The expanded support member functions as a support for applying a filler compound to mend the hole.

2. Description of the Background Art

Prior appliances employed to provide a supporting surface for the application of a filler compound to repair holes in walls were either too complex in their construction or in their use and often involved secondary patching to mend small access holes necessary in using the particular device. A need existed for a method and device that would allow an individual to introduce a wall space support in a rapid manner and to fill the hole with repair material directly on top of the inserted wall space support.

U.S. Pat. No. 3,582,122 discloses a repair patch for wallboards that includes a folded panel that is introduced into a wall space and expanded by unfolding to a size larger than the hole to be filled. A string is employed to hold the panel in position while an anchoring screw is introduced to secure the panel against the wall with the hole.

Described in U.S. Pat. No. 3,939,988 is an elaborate repair device for restoring a damaged dry wall board. This device has a complex construction including opposing plates and adapters that are expanded within a wall space by a spring mechanism. Once expanded, the filler compound may be applied the plate immediately within the damage hole.

A plug device for repairing holes in walls and a method of use are related in U.S. Pat. No. 4,062,165. The device has a two piece cylindrical semi-rigid body comprising a handle section and a plug section. The device is inserted within the damage hole and when correctly positioned the handle is snapped off leaving a plug support for the filler compound.

U.S. Pat. No. 4,075,809 discloses a hole repair device employing a dish shaped resilient member having a centrally disposed threaded opening that receives an elongated screw with a pointed end. The dish member collapses to fit through the damage hole into the wall space. The screw serves to hold the expanded dish member within the wall space, against the damage hole, and may be broken off at a point behind the final wall surface.

A sandwich-like hole repair device is described in U.S. Pat. No. 4,100,712. A collapsible support member is inserted within a damage hole and expanded against the inside wall surface by anchoring with a screw to a thin reaction member on the outside wall surface. After filling the damage hole with filler compound, the reaction member may be rotated to provide a smooth final surface. Once partially or completely dried, the screw is removed and the remaining small hole filled.

U.S. Pat. No. 4,285,183 explains a wallboard patching apparatus having a deformable base that compresses to be fitted within a damage hole in a wall. An adhesive is employed to affix the base against the inner surface of the wall. To position and hold the base for adhesive attachment, a lock pin is removable secured to the base. The lock pin is adapted to hook over a wire bridge member used during the adhesive drying process. After the adhesive sets the lock pin is removed and the damage hole filled with filler compound.

U.S. Pat. No. 4,297,823 divulges a hollow wall repair device comprising a plate member that fits within a damage hole. A positioner guide for aligning the plate member within a damage hole and a positioner wire for holding the plate member flush with the inside wall surface are part of the device. Depending upon the shape of the hole to be repaired, a sized outer wall surface cap fits into the damage hole. The positioner wire runs through the surface cap and is pulled to mate the plate member and the cap within the damage hole. To obtain a fit that is flush with the outer wall surface, the outer wall needs to be prepared by removing wall material to accommodate the surface cap and its associated positioner guides. A bolt is utilized to anchor the plate member and cap within the damage hole.

Related in U.S. Pat. No. 4,335,554 is an adjustable support device to secure a patch in a hollow wall. A patch is sized to fit within a damage hole and attached by adhesive pads to one or more blocks each having a channel for receiving a bar element. The bar elements have additional adhesive pads attached proximate each end and facing the sized patch. The device is inserted within the wall and pulled outward, away from the wall, this action forces the adhesive pads on the bar elements to stick to the inner wall surface.

An elaborate plug for holes in walls is illustrated in U.S. Pat. No. 4,408,429. This device has several parts that function to force opposing plates against the inner surfaces of a wall space. Once inserted within the wall space and correctly positioned, a compressed device is expanded by means of a released spring. After inserting, positioning, and expanding the device, an insertion handle is removed and the damage hole filled with filler compound.

Finally, described in U.S. Pat. No. 4,715,151 is a plasterboard repair kit having a cube-like inflatable support member, an integral filling valve, and a compressed gas cylinder holder fitted with a nozzle for mating with the filling valve to fill the inflatable member with gas. The deflated support member is inserted through the damage hole and inflated by mating a gas containing holder with the filling valve and releasing the gas. The holder is removed and the damage hole filled with a suitable patching material.

SUMMARY OF THE INVENTION

An object of the present invention is to provide an improved device and method for repairing holes in walls.

Another object of the present invention is to construct a wall repair device that is inexpensive to produce, disposable, and easy to use.

An additional object of the present invention is to furnish a wall repair device that delivers a wall space support into the gap between wall surfaces in one quick motion by the user.

A further object of the present invention is to provide a wall space support that is pliable enough to be inserted easily through a hole in a wall and into a wall space between the wall surfaces, yet firm enough to accept a hole filler compound applied to its surface for repairing the hole.

The subject invention, a wall hole repair device, comprises a plunger that is shaped and sized to fit within a similarly shaped barrel. The barrel is of appropriate diameter to fit within a hole in a wall surface. An essentially reversibly compressible support member compresses and inserted within the barrel. The combined barrel and support member are inserted into a hole in a wall surface and the plunger mated with the opposite end of the barrel. By forcing the plunger within the barrel, towards the wall surface, the support member in injected or delivered into the wall space behind the damaged wall surface. Once delivered into the wall space, the support member expands. After removing the barrel and plunger from the hole, the expanded support member provides a support surface upon which a filler compound is layered to mend the hole.

Other objects, advantages, and novel features of the present invention will become apparent from the detailed description that follows, when considered in conjunction with the associated drawings.

DESCRIPTION OF THE PREFERRED EMBODIMENT

Figure 1:
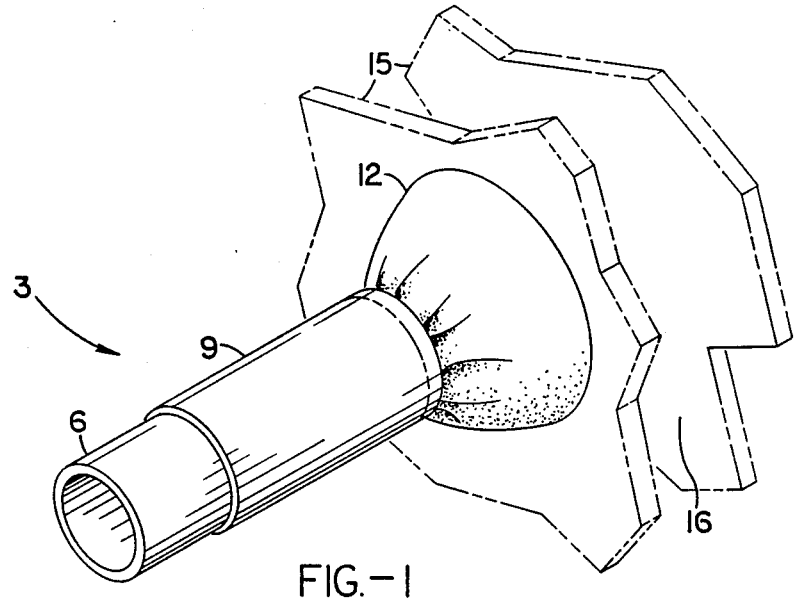
FIG. 1 is a pictorial view of the device in use showing the injection or delivery of the compressible support member into a transparent wall section.

Referring now to FIGS. 1–4, there is shown a preferred embodiment of a wall repair device 3 of the subject invention. This device 3 is for aiding an individual in quickly repairing holes in a wall surface. FIG. 1 illustrates the use of the subject invention, comprising a plunger 6, a barrel 9, and a support member 12. In order to show the subject device 3 in operation, a transparent wall section has been drawn in FIG. 1 displaying two wall surfaces 15 and a wall space or cavity 16 between the wall surfaces 15.

Figure 2:
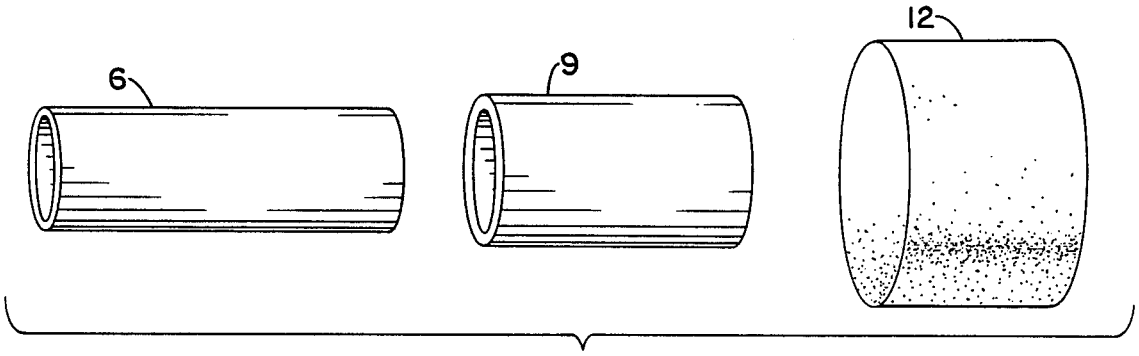
FIG. 2 is a perspective of the disassembled device.
Figure 3:
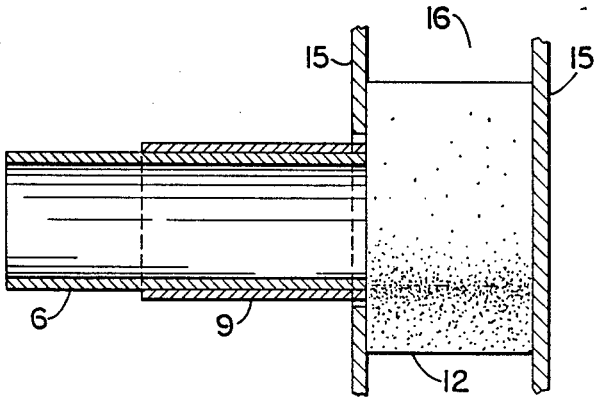
FIG. 3 is a cross sectional view of the device inserted in a hole of a wall surface, wherein the support member has been delivered into the wall space and has expanded.

As illustrated in particular in FIG. 2, the device 3 has three components. The plunger 6 is shown in the preferred embodiment as having a cylindrical shape, however, it is understood that this cylindrical shape may be altered to any equivalent shape such as square, triangular, hexagonal, or like regular or irregular proportions so long as it fits within the barrel 9. Further, the plunger 6 need not be hollow or tube-like, as depicted in FIGS. 1–3. A solid plunger 6 is contemplated as being within the realm of this disclosure, but a hollow or tube-like configuration is preferred for the plunger 6. When packaged for marketing, such a cylindrical tube-like plunger 6 provides an internal space for placing a container of filler compound. The plunger 6 may be fabricated from appropriately rigid materials such as rolled paper, cardboard, plastic, and the like.

As seen in FIGS. 1–3, the plunger 6 fits within a barrel 9. The barrel 9 is preferably a cylindrical tube-like form, but as with the plunger 6, any equivalent shape is amenable with this disclosure such as square, triangular, hexagonal, or like regular or irregular proportion so long as it allows a similarly shaped plunger 6 to mate within its inner surfaces. The barrel 9 usually has a length less than that of the plunger's 6 length, but substantially equal lengths are possible and a barrel 9 length greater than the length of the plunger 6 is also contemplated. Since the barrel 9 is to fit within a hole in a wall surface 15, the barrel 9 generally has an outer diameter shaped or sized to fit within the hole in the wall surface. Although the subject device 3 may be employed in repairing a hole when the barrel 9 does not exactly fit within the hole, the device's 3 operation is easier when such a mating is achieved. Like with the plunger 6, the barrel 9 may be fabricated from any suitably rigid materials such as rolled paper, cardboard, plastic, or the like.

Figure 4:
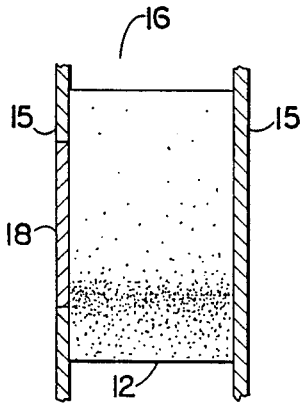
FIG. 4 is a cross sectional view of the expanded support member within a repaired wall.

The support member 12 is shown in FIGS. 1–4 and particularly in FIG. 2. This support member 12 may be of any shape including cylindrical, square, triangular, or other regular or irregular forms, preferably cylindrical with generally flattened end surfaces. Essential to the functionality of the subject invention device 3 is the essentially reversible compressibility of the support member 12. To create a support foundation within a wall space 16 behind a hole in the wall's surface 15, for applying a filler compound, the support member 12 needs to collapse sufficiently to be introduced through the hole yet once within the wall space 16 expand to fill the gap between the two wall surfaces 15, see FIG. 3. As seen in FIG. 4, the expanded support member 12 thereby supplies a surface upon which to apply the filler compound to produce a patch 18.

The support member 12 may be manufactured from suitable materials that allow essentially reversible compression to occur. Foam rubbers of varying compositions are preferred, however other like polymers are considered within the scope of this disclosure. In order that the foam rubber or functionally equivalent polymer support member 12 expands fully or nearly completely, it is preferred that the support member 12 be fitted within the barrel 9 just before using the device 3.

Thus, to employ the subject device 3, consider FIGS. 1, 3, and 4, a user compresses the support member 12 and fits it into the barrel 9. The barrel 9 is then inserted within a hole in a wall surface 15 and the plunger 6 mated with the barrel 9 at the end not fitted within the hole. Plunger 6 is forced within the barrel 9 to inject the support member 12 into the wall space 16. FIG. 1 clearly shows the support member 12 expanding as it enters the wall space 16. The empty barrel 9 and the plunger 6 are removed from the hole and an appropriate filler compound such as plaster, putty, synthetic polymer, or equivalent material is applied to mend the hole.

For convenience, the device 3 may be packaged in kit form. Such a kit would comprise a plunger 3, a barrel 9, one or more support members 12, and a filler compound. An applicator for the filler compound might be included in such a kit. Realizing that holes in walls come in varied sizes, the diameter dimensions of the device's 3 components may vary to accommodate this possibility. Therefore, a kit may contain a plurality of devices 3 to mate with varied hole sizes.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A device for repairing a hole in a wall surface, comprising:

(a) a plunger;

(b) a barrel with an inner diameter shaped to receive said plunger; and (c) a support member compressibly fitted within said barrel, wherein when said plunger is inserted within said barrel, fitted within said hole in said wall surface, said support member is delivered in an expanded form into a wall space behind said wall surface.

2. A device according to claim 1, wherein said plunger is hollow.

3. A device according to claim 1, wherein said support member is fabricated from an essentially reversibly compressible polymer material.

4. A device for repairing a hole in a wall surface, comprising:

(a) a cylindrical plunger;

(b) a cylindrical tube-like barrel with an inner diameter sized to receive said cylindrical plunger; and (c) a support member compressibly fitted within said cylindrical tube-like barrel, wherein when said cylindrical plunger is inserted within said cylindrical tube-like barrel, fitted within said hole in said wall surface, said support member is delivered in an expanded form into a wall space behind said wall surface.

5. A device according to claim 4, wherein said cylindrical plunger is hollow and tube-like.

6. A device according to claim 4, wherein said support member is fabricated of an essentially reversibly compressible polymer material.

7. A device according to claim 4, wherein said support member is cylindrical with generally flat parallel ends.

8. A method of repairing a hole in a wall surface, comprising the steps of:

(a) inserting a compressed support member fabricated entirely from an essentially reversibly compressible polymer material through a hole in a wall surface and into a wall space behind said hole;

(b) allowing said compressed support member to expand within said wall space;

(c) positioning said expanded support member within said wall space so as to provide a support backing for the application of a hole repairing compound; and (d) applying said hole repairing compound to fill said hole.

9. A kit for repairing a hole in a wall surface, comprising:

(a) a plunger;

(b) a barrel with an inner diameter shaped to receive said plunger; and (c) a support member which may be compressibly fitted within said barrel, wherein when said plunger is inserted within said barrel, fitted within said hole in said wall surface, said support member is delivered in an expanded form into a wall space behind said wall surface.

10. A kit according to claim 9, further comprising a hole repairing compound for filling said hole in said wall surface.

11. A kit according to claim 9, wherein said support members are fabricated from essentially reversibly compressible polymer material.

12. A kit for repairing a hole in a wall surface, comprising:

(a) a cylindrical plunger;

(b) a cylindrical tube-like barrel with an inner diameter sized to receive said cylindrical plunger; and (c) a support member which may be compressibly fitted within said cylindrical tube-like barrel, wherein when said cylindrical plunger is inserted within said cylindrical tube-like barrel, fitted within said hole in said wall surface, said support member is delivered in an expanded form into a wall space behind said wall surface.

13. A kit according to claim 12, further comprising a hole repairing compound for filling said hole in said wall surface.

* * * * *